US008365359B2

(12) United States Patent
Morishita et al.

(10) Patent No.: US 8,365,359 B2
(45) Date of Patent: Feb. 5, 2013

(54) HINGE DEVICE

(75) Inventors: Masazumi Morishita, Tokyo (JP); Masaya Yamazato, Tokyo (JP)

(73) Assignee: Sugatsune Kogyo Co., Ltd., Tokyo (JP)

( * ) Notice: Subject to any disclaimer, the term of this patent is extended or adjusted under 35 U.S.C. 154(b) by 2 days.

(21) Appl. No.: 13/063,851

(22) PCT Filed: Aug. 4, 2009

(86) PCT No.: PCT/JP2009/063785
§ 371 (c)(1),
(2), (4) Date: Mar. 14, 2011

(87) PCT Pub. No.: WO2010/029821
PCT Pub. Date: Mar. 18, 2010

(65) Prior Publication Data

US 2011/0162170 A1 Jul. 7, 2011

(30) Foreign Application Priority Data

Sep. 12, 2008 (JP) ..... 2008-235392

(51) Int. Cl.
*E05D 7/00* (2006.01)

(52) U.S. Cl. ..... 16/354; 16/366

(58) Field of Classification Search ..... 16/366, 16/368–370, 280–282, 286–288, 299, 312, 16/313, 315; 296/146.11, 146.12; 49/246–248; 244/129.4, 129.5
See application file for complete search history.

(56) References Cited

U.S. PATENT DOCUMENTS

| | | | | |
|---|---|---|---|---|
| 2,604,653 | A * | 7/1952 | Anderson et al. | 16/315 |
| 3,016,261 | A * | 1/1962 | Tatter | 49/246 |
| 3,098,258 | A * | 7/1963 | Ruiz | 16/50 |
| 4,607,812 | A * | 8/1986 | De Haan et al. | 244/129.5 |
| 4,951,351 | A * | 8/1990 | Eckel | 16/284 |
| 5,289,615 | A * | 3/1994 | Banks et al. | 16/366 |
| 5,600,868 | A * | 2/1997 | Tourville et al. | 16/277 |
| 6,834,834 | B2 * | 12/2004 | Dazet et al. | 244/129.5 |
| 6,997,504 | B1 * | 2/2006 | Lang et al. | 296/146.11 |

(Continued)

FOREIGN PATENT DOCUMENTS

| | | |
|---|---|---|
| DE | 19827813 A1 * | 12/1999 |
| JP | 2-274988 | 11/1990 |

(Continued)

OTHER PUBLICATIONS

International Search Report, PCT/JP2009/063785, Sep. 8, 2009.

*Primary Examiner* — Chuck Y. Mah
(74) *Attorney, Agent, or Firm* — Young & Thompson

(57) ABSTRACT

A hinge device increases an open angle of a second member relative to a first member without enlarging the hinge device. A first pulley is fixed to a first mounting member mounted on the first member. A second pulley is fixed to a second mounting member mounted on the second member. A timing belt runs between the first and second pulleys. One end of a connecting member that connects the first mounting member to the second connecting member connects rotatably to an axis part of the first mounting member, with the opposite end connected rotatably to an axis part of the second mounting member. Pins to that abut to the outside of the timing belt are provided such that the width between one side and the opposite side of the timing belt becomes smaller than the diameter of at least one of the first pulley and the second pulley.

20 Claims, 14 Drawing Sheets

U.S. PATENT DOCUMENTS

| | | | | |
|---|---|---|---|---|
| 7,127,778 | B2 | 10/2006 | Salice | |
| 7,328,484 | B2 | 2/2008 | Salice | |
| 7,520,028 | B2 * | 4/2009 | Borleis et al. | 16/366 |
| 2002/0170143 | A1 * | 11/2002 | Vitry | 16/231 |
| 2004/0093693 | A1 | 5/2004 | Salice | |
| 2007/0067958 | A1 | 3/2007 | Salice | |
| 2007/0084016 | A1 * | 4/2007 | Bommelmann et al. | 16/366 |
| 2007/0096503 | A1 | 5/2007 | Borleis et al. | |

FOREIGN PATENT DOCUMENTS

| | | | |
|---|---|---|---|
| JP | 2004-162523 | | 6/2004 |
| JP | 2006-526719 | | 11/2006 |
| JP | 2007-523278 | | 8/2007 |
| SU | 1740232 | A1 * | 6/1992 |

* cited by examiner (S1)

(S2)

(S3)

CROSS SECTIONAL VIEW TAKEN ALONG THE LINE VII-VII

CROSS SECTIONAL VIEW TAKEN ALONG THE LINE XI-XI

CROSS SECTIONAL VIEW TAKEN ALONG THE LINE XIII-XIII

HINGE DEVICE

TECHNICAL FIELD

The present invention relates to a hinge device for closing and opening a second member relative to a first member.

BACKGROUND ART

As a hinge device of this type, there are a hinge device for an auto car with which a door is used to open and closes an opening of a vehicle body while maintaining the parallel attitude of the door relative to the vehicle body and a hinge device with which a door is used to open and close an opening of a body while maintaining the parallel attitude of the door relative to the body of an airplane (see patent document 1).

As illustrated in FIG. 15, a link 73 is connected to a vehicle body 71 of an auto car and its door 72. An end of the link 73 is connected to an axis part 71*a* of the vehicle body 71 rotatably and the other end of the link 73 is connected to an axis part 72*a* of the door 72 rotatably. Besides, a first pulley 74 is connected integrally with the axis part 71*a* of the vehicle body 71 and a second pulley 75 is connected integrally with the axis part 72*a* of the door 72. Between these first pulley 74 and second pulley 75, a timing belt 76 is placed thereover.

When the door 72 gets opened or closed, the link 73 rotates on the axis part 71*a* of the vehicle body 71 and the door 72 turns on the axis part 71*a* of the vehicle body 71. Here, the link 73 rotates a predetermined angle in the clockwise direction around the axis part 71*a* of the vehicle body 71, the first pulley 74 fixed to the axis part 71*a* of the vehicle body 71 is rotated a predetermined angle in the counterclockwise direction relative to the link 73. Counterclockwise rotation of the first pulley 74 relative to the link 73 is transmitted to the second pulley 75 by the timing belt 76, and the second pulley 75 rotates a predetermined angle in the counterclockwise direction relative to the link 73. The attitude of the door 72 relative to the vehicle body 71 is defined by combination of the rotation angle of the link 73 relative to the axis part 71*a* of the vehicle body 71 and the rotation angle of the second pulley 75 relative to the link 73. As the rotation angle of the link 73 and the rotation angle of the second pulley 75 relative to the link 73 cancel out each other, when opening or closing the door 72, the attitude of the door 72 is maintained fixed and the door 72 is pivoted around the axis part 71*a* of the vehicle body 71 while it keeps parallel with the back-and-forth direction of the vehicle body 71.

In such a hinge device, the axis part 71*a* of the vehicle body 71 is fixed to the inner surface of the vehicle body 71 and the axis part 72*a* of the door 72 is fixed to a back surface of the door 72. Therefore, if the open angle of the door 72 is to be increased, the link 73 interferes with the inner surface of the vehicle body and the open angle of the door 72 cannot be increased. In order to increase the open angle of the door 72, as illustrated in FIG. 16, the link 73 and the timing belt 76 are bent into L shape at their midpoint so as to prevent interference of the link 73 and the timing belt 76 with the inner surface of the vehicle body 71.

CITATION LIST

Patent Literature

PL1: Japanese Patent Application Laid-Open No. 2007-523278

SUMMARY OF INVENTION

Technical Problem

The attitude of the door is maintained by the first pulley, the second pulley and the timing belt that runs between them. In order to keep the attitude of the door stable, it is necessary to make the diameters of the first and second pulleys larger. When the diameters of the first and second pulleys are increased, the width of the timing belt that runs between the first and second pulleys becomes larger and the link that connects the vehicle body to the door and the timing belt are likely to interfere with the inner surface of the vehicle body.

However, if the link and the timing belt are bent into L shape like in the conventional hinge device, the hinge device is inevitably upsized and there needs to be a large space for installing the hinge device on the inner surface of the vehicle body. Particularly, when the door gets closed, the link and timing belt bent into L shape jut toward the inside of the vehicle. Besides, when the timing belt is bent into L shape, rotation is difficult to transmit from the first pulley to the second pulley, which causes problems of unstable attitude of the door and short service life of the timing belt.

Then, the present invention has an object to provide a hinge device which has a larger open angle of the second member relative to the first member, while preventing upsizing of the hinge device.

Solution to Problem

In order to solve the above-mentioned problems, a first aspect of the present invention is a hinge device for opening and closing a second member relative to a first member, comprising: a first mounting member that is mounted on the first member; a second mounting member that is mounted on the second member; a first pulley that is fixed to the first mounting member; a second pulley that is fixed to the second mounting member; a looping member that runs between the first pulley and the second pulley; a connecting member that is connected to the first mounting member to be rotatable around the first pulley and is connected to the second mounting member to be rotatable around the second pulley; and an abutting part that abuts to an outside of the looping member in such a manner that a width between one side of the looping member and an opposite side thereof becomes smaller than a diameter of at least one of the first pulley and the second pulley.

A second aspect of the present invention is characterized in that, in the hinge device of the first aspect, the abutting part has at least two first-pulley side abutting parts that are provided near the first pulley and abut to the one side and the opposite side of the looping member, respectively, in such a manner that a looping angle of the looping member on the first pulley is greater than 180 degrees.

A third aspect of the present invention is characterized in that, in the hinge device of the second aspect, the abutting part has at least two second-pulley side abutting parts that are provided near the second pulley and abut to the one side and the opposite side of the looping member, respectively, in such a manner that a looping angle of the looping member on the second pulley is greater than 180 degrees.

A fourth aspect of the present invention is characterized in that, in the hinge device of any one of the first to third aspects, the connecting member has two or more split connecting members that are split at the first pulley and the second pulley, the abutting part is provided at at least one of the split connecting members, and a tension is applied to the looping member from the abutting part by connecting the split connecting members to each other.

A fifth aspect of the present invention is characterized in that, in the hinge device of the fourth aspect, in at least one of the split connecting members, a first pulley groove and a second pulley groove are formed for fitting the first pulley and the second pulley therein, respectively, and a looping member groove is formed for fitting the looping member therein.

A sixth aspect of the present invention is characterized in that, in the hinge device of any one of the first to fifth aspects, the abutting part comprises a pin that is fit in the connecting member rotatably, and when the looping member runs, the pin abuts to the looping member and the pin rotates around a center line thereof.

A seventh aspect of the present invention is characterized in that, in the hinge device of any one of the first to sixth aspects, in the first mounting member and the second mounting member, axis parts to which the first pulley and the second pulley are connected and gears connected to the axis parts are provided respectively, a rotary damper that engages with the gears is fit in the connecting member, and when the connecting member is rotated relative to the second mounting member and the first mounting member, the rotary damper generates a damping force that resists relative rotation of the connecting member.

An eighth aspect of the present invention is characterized in that, in the hinge device of any one of the first to seventh aspects, in the first mounting member and the second mounting member, axis parts to which the first pulley and the second pulley are connected and protruding pins connected to the axis parts are provided respectively, a cam body that is slidable in an axis direction of the axis parts and stopped to rotate by the connecting member and biasing member for biasing the cam body to the protruding pins are fit in the connecting member, and when the connecting member is rotated relative to the second mounting member and the first mounting member, a torque is applied to the connecting member by a biasing force of the biasing means.

Advantageous Effects of Invention

According to the present invention, as the width between one side and the opposite side of the looping member is narrowed by the abutting part, it is possible to narrow the width of the part that connects the first mounting member to the second mounting member. This makes it possible to prevent interference between the part that connects the first mounting member to the second mounting member with the edge of the opening and to increase the open angle of the second member relative to the first member.

DESCRIPTION OF EMBODIMENTS

Figure 1:
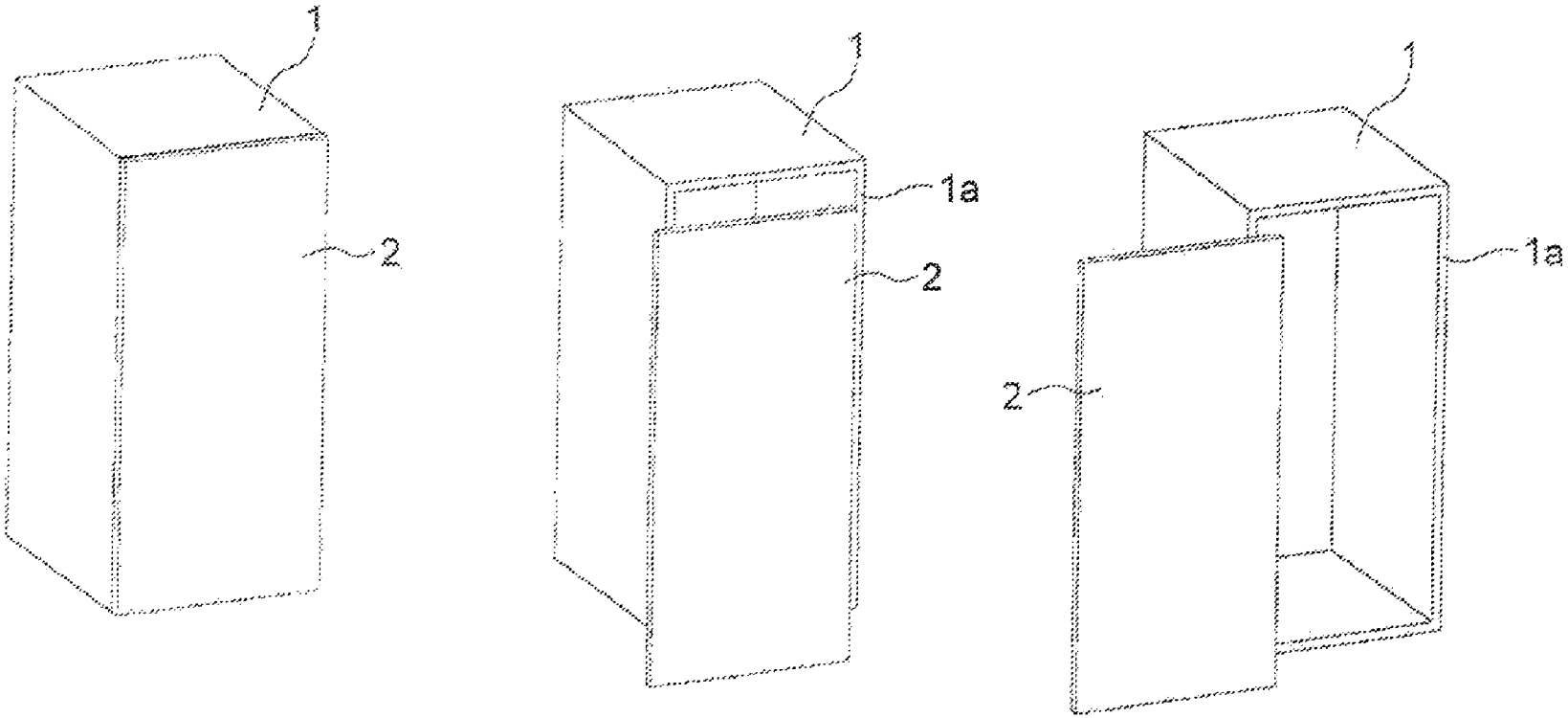
FIG. 1 is a perspective view of furniture on which a hinge device according to an embodiment of the present invention is mounted.

With reference to the attached drawings, a hinge device according to an exemplary embodiment of the present invention will be described in detail below. FIG. 1 is a perspective view of furniture on which a hinge device is mounted. This furniture has a box-shaped housing 1 as a first member and a rectangular door 2 as a second member mounted on a front surface of the housing 1. When the door 2 is closed, the door 2 is in touch with the entire periphery of a square frame 1*a* of the housing 1 (S1). The door 2 has a door knob mounted thereon (not shown). When the knob is used to open the closed door 2, the door 2 rotates to the left in the figure relative to the housing 1 while maintaining its parallel position relative to the plane including the frame 1*a* of the housing 1 (S2→S3).

Figure 2:
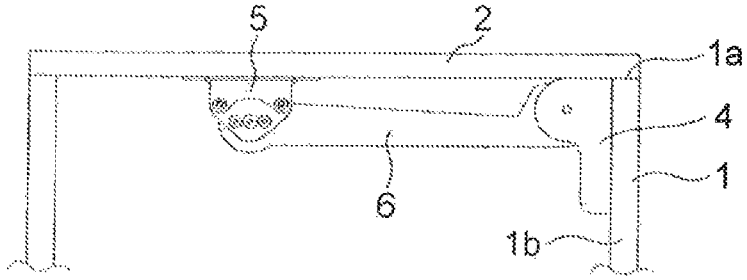
FIG. 2 is a plan view of the hinge device mounted on the furniture.
Figure 2:
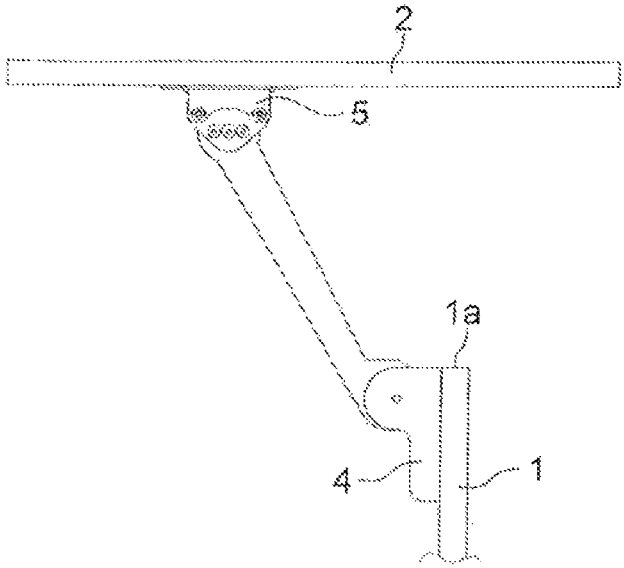
Figure 2:
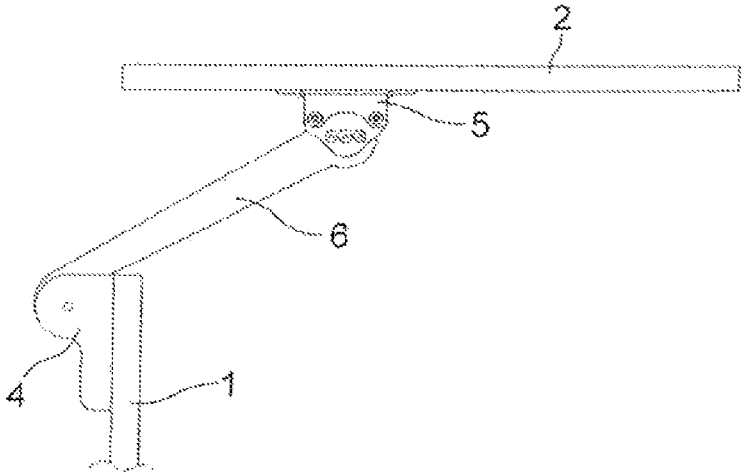

FIG. 2 is a plan view of the hinge device connected to the housing 1 and the door 2. In an inner surface lb of the housing 1, a first mounting member 4 is mounted thereon with use of fixing means such as a screw. In a back surface of the door 2, a second mounting member 5 is mounted thereon with use of fixing means such as a screw. The first mounting member 4 is connected to the second mounting member 5 via a connecting member 6. The connecting member 6 is rotatable on the axis part of the first mounting member 4 relative to the first mounting member 4. The connecting member 6 is rotatable on the axis part of the second mounting member 5 relative to the second mounting member 5. Turn of the door 2 when the door 2 opens or closes is performed on the axis part of the first mounting member 4. When the door 2 is closed, the door 2 is in touch with the left and right sides of the frame of the housing 1 (S1). When opening the door 2, the door 2 turns around the axis part of the first mounting member 4 mounted on the housing 1 (S2). Then, the attitude of the door 2 is kept in parallel with the plane including the frame of the housing 1. When the door 2 is opened fully, the connecting member 6 is in touch with the first mounting member 4 and is prevented from rotating a predetermined angle or more (S3). The parallel attitude of the door 2 is also maintained while the door 2 is opened fully.

Figure 3:
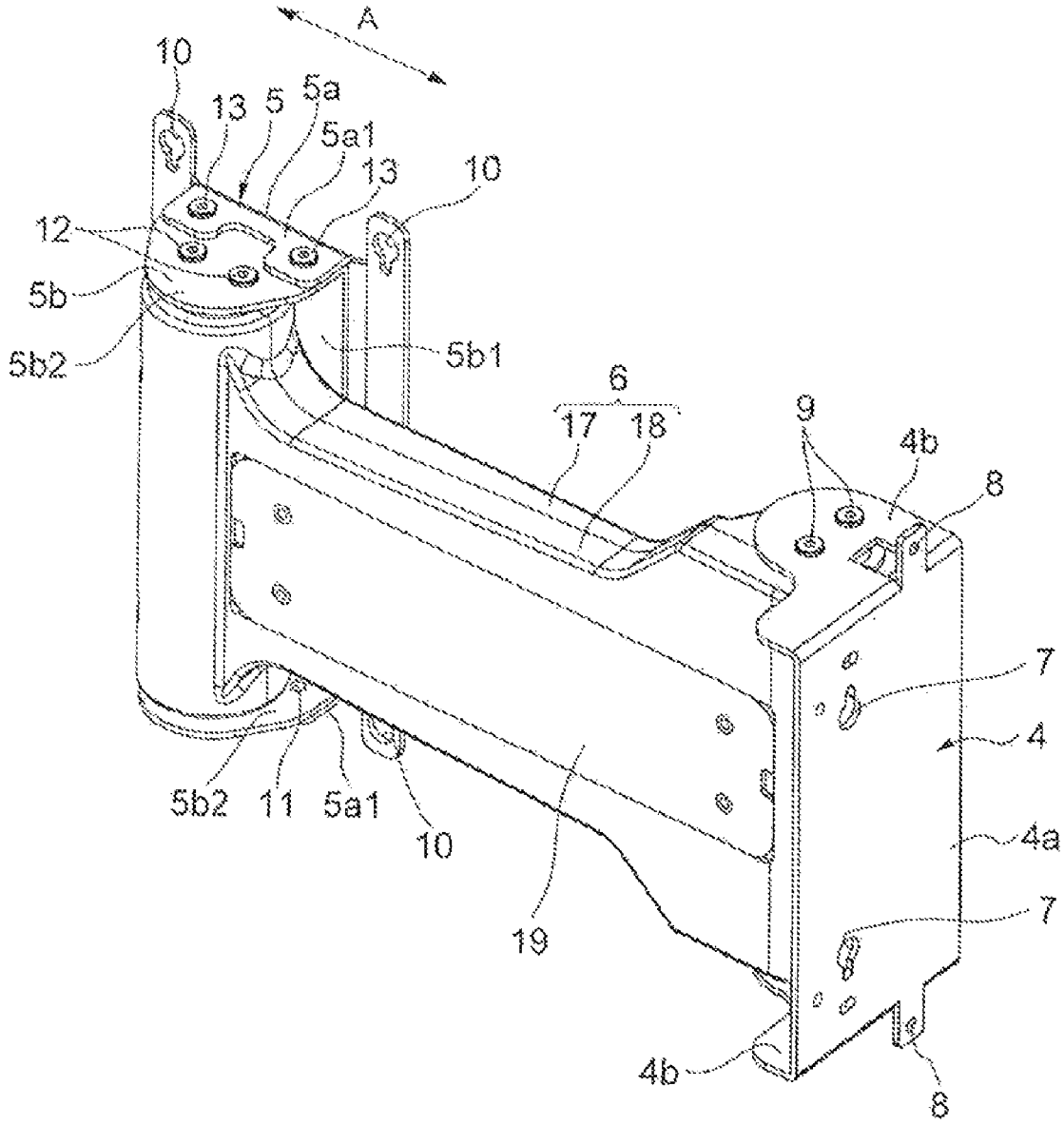
FIG. 3 is an outline perspective view of the hinge device.
Figure 4:
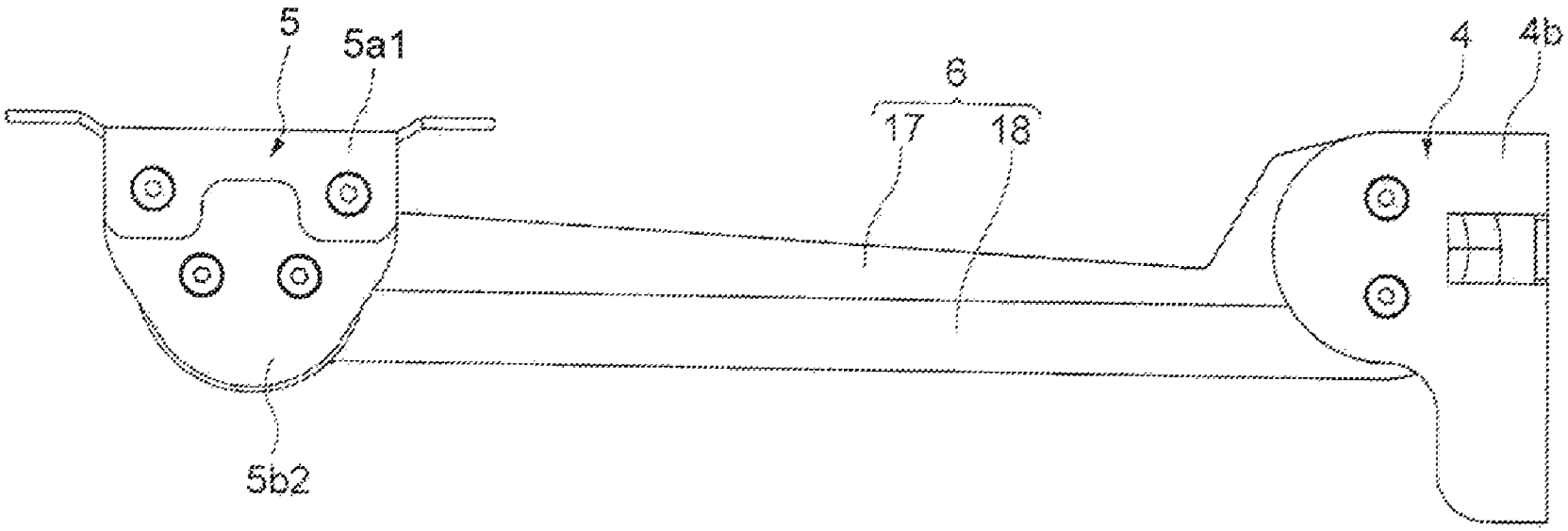
FIG. 4 is a plan view of the hinge device.
Figure 5:
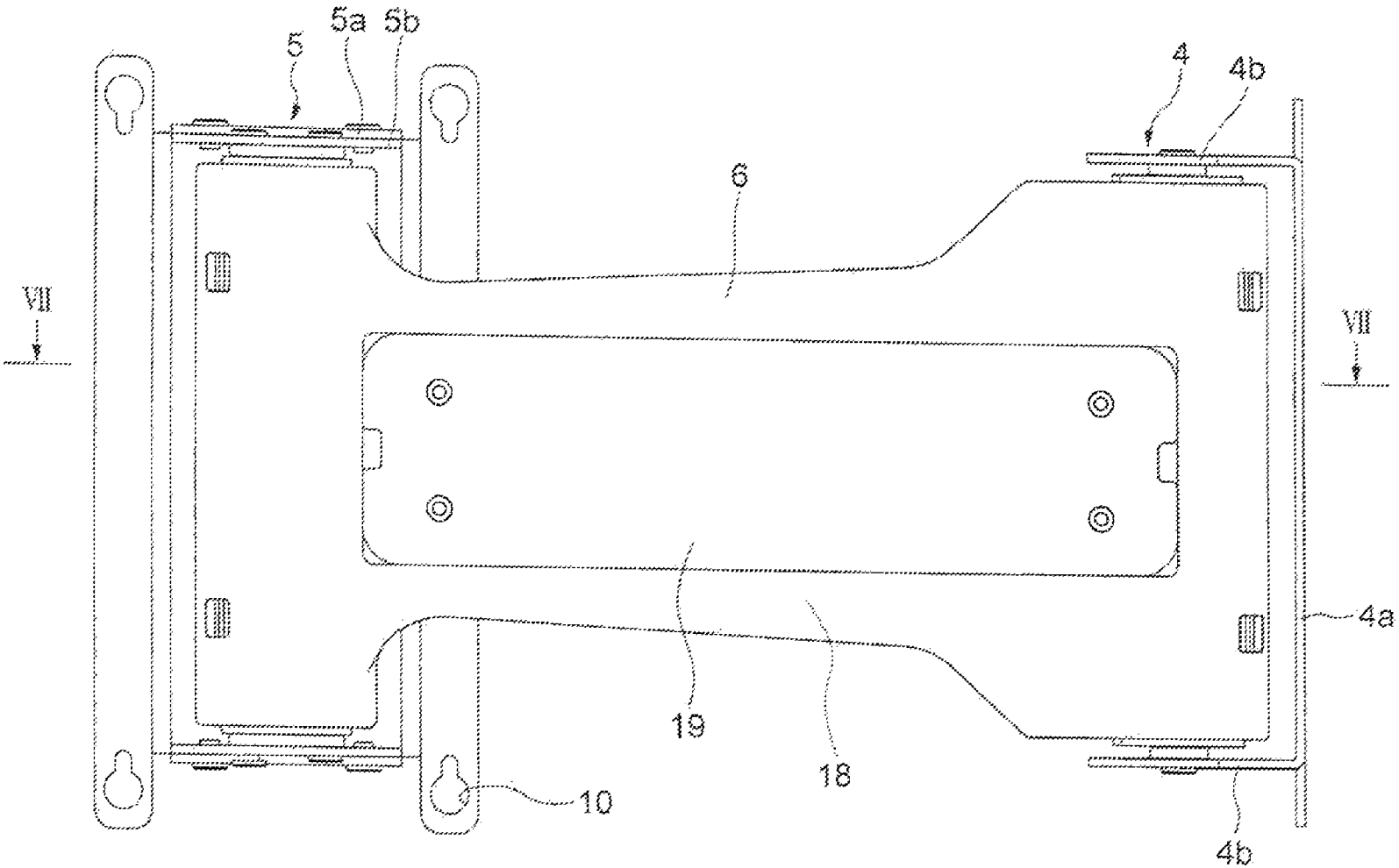
FIG. 5 is a side view of the hinge device.

FIGS. 3 to 5 are outline views of the hinge device. FIG. 3 is a perspective view, FIG. 4 is a plan view and FIG. 5 is a side view. As illustrated in FIG. 3, the first mounting member 4 is formed by bending a thin plate. The first mounting member 4 has a main plate 4*a* that is mounted on the inner surface lb of the housing 1 and a pair of end plates 4*b* that is bent 90 degrees at the upper or lower part of the main plate 4*a*. The main plate 4*a* has a plurality of mounting holes 7, 8 with which the first mounting member 4 is mounted on the inner surface lb of the housing 1. The paired upper/lower end plates 4*b* are in parallel with each other. Between the end plates 4*b*, the axis part 21 (see FIG. 6), which is described later, is connected thereto with use of connecting means such as a screw 9.

The second mounting member 5 has a door mounting plate 5*a* that is mounted on the back surface of the door 2 and an axis part support plate 5*b* for supporting the axis part described later, the door mounting plate 5*a* and the axis part support plate 5*b* being connected to each other. In the door mounting plate 5*a*, mounting holes 10 are formed for mounting the door mounting plate 5*a* onto the back surface of the door 2. Upper and lower end parts 5*a*1 of the door mounting plate 5*a* are bent into L shape. Between the paired end parts 5*a*1, the axis part support plate 5*b* is connected thereto with use of connecting means such as a screw 13. In each of the paired end parts Sal, a long hole is formed so that the axis part support plate 5*b* can be moved in the direction of A in the figure relative to the door mounting plate 5*a*. The mounting position of the door can be adjusted by loosening the screw 13. The axis part support plate 5*b* has a main plate 5*b*1 extending vertically and a pair of upper/lower end plates 5*b*2 bent 90 degrees relative to the main plate 5*b*1. In each of the end plates 5*b*2, a screw hole 11 is formed for mounting the axis part support plate 5*b* to the door mounting plate 5*a*. Besides, between the paired end plates 5*b*2, an axis part 27 (see FIG. 6), which is described later, is connected thereto with use of connecting means such as a screw 12.

Both of right/left-side end parts of the connecting member 6 are connected rotatable to the axis part of the first mounting member 4 and the axis part of the second mounting member 5. The connecting member 6 is divided at the axis parts of the first mounting member 4 and the second mounting member 5 into the front side and the back side in the figure. A name plate 19 is attached to the front-side split connecting member 18.

Figure 6:
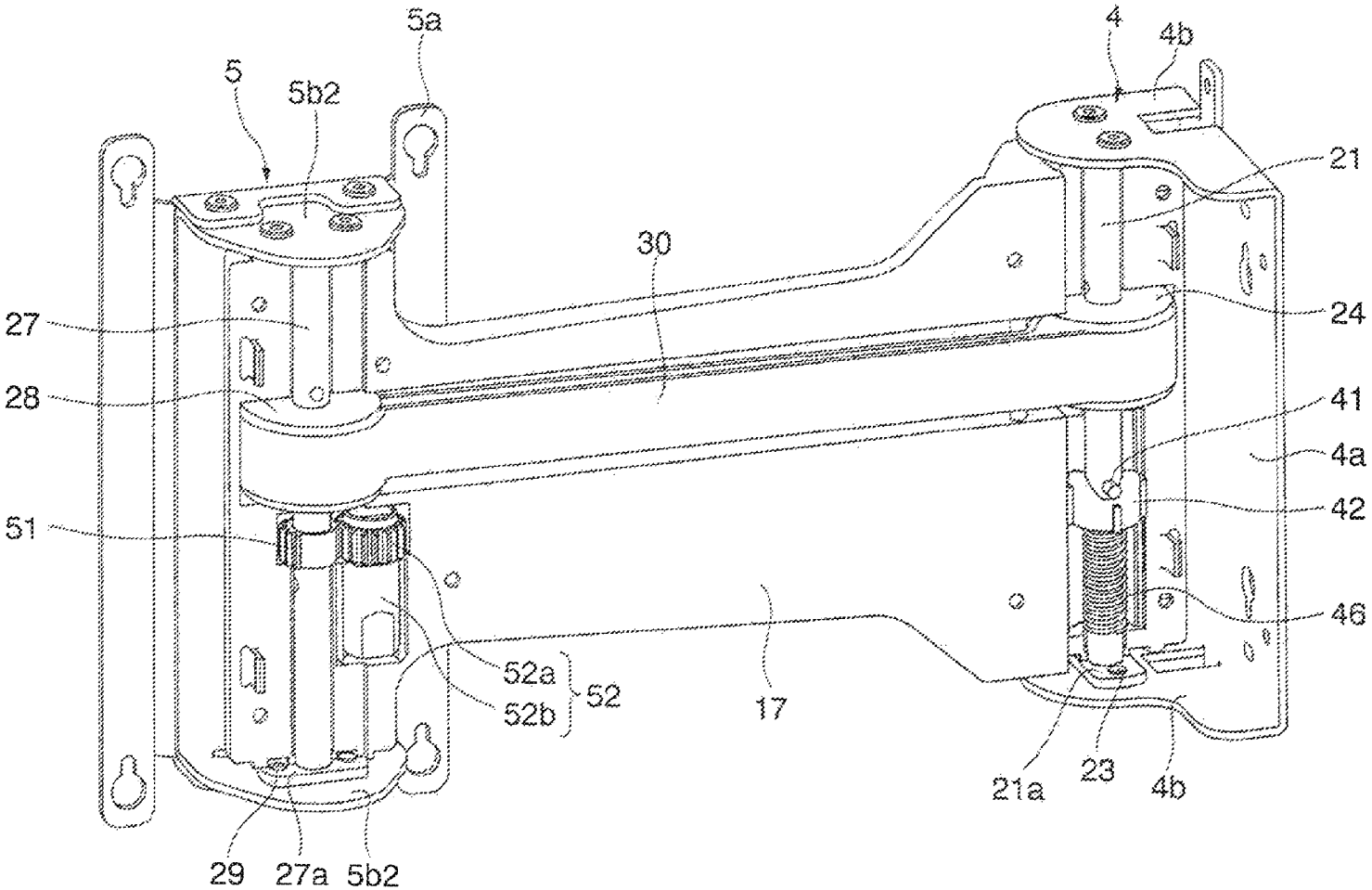
FIG. 6 is a perspective view of the hinge device from which a front-side split connecting member is removed.

FIG. 6 is a perspective view of the hinge device from which the front-side split connecting member 18 is removed. To the first mounting member 4, an axis part 21 extending vertically is connected integrally. At each end part of the axis part 21 in the longitudinal direction, a flange 21*a* is formed overhanging in the radial direction. In the flange 21*a*, a screw hole 23 is formed for mounting the axis part 21 to the end plate 4*b* of the first mounting member 4. At a midpoint of the axis part 21 in the longitudinal direction, a first pulley 24 is connected thereto integrally. The first pulley 24 is a timing belt pulley, in which grooves are formed in parallel with the axis part in the outer peripheral surface of the first pulley 24. As the first pulley 24 is connected integrally with the axis part 21 and the axis part 21 is connected integrally with the first mounting member 4, the first pulley 24 is connected integrally with the first mounting member 4. The diameter of the first pulley 24 is set so large as to change the attitude of the door 2 and maintain the changed attitude of the door 2 fixed.

To the second mounting member 5, an axis part 27 extending vertically is connected thereto. At each end part in the longitudinal direction of the axis part 27, a flange 27*a* is formed overhanging in the radial direction. In the flange 27*a*, a screw hole 29 is formed for mounting the axis part 27 to the endplate 5*b*2 of the second mounting member 5. At the midpoint of the axis part 27 in the longitudinal direction, a second pulley 28 is connected thereto. The diameter of this second pulley 28 is equal to the diameter of the first pulley 24. The second pulley 28 is a timing belt pulley, in which grooves are formed in parallel with the axis part in an outer peripheral surface of the second pulley 28. As the second pulley 28 is connected integrally to the axis part 27 and the axis part 27 is connected integrally with the second mounting member 5, the second pulley 28 is connected integrally with the second mounting member 5.

Between the first pulley 24 and the second pulley 28, a timing belt 30 is placed thereover as a looping member. The timing belt 30 has equally spaced teeth inside. They are engaged with the teeth formed on the outer periphery of the first and second pulleys 24, 28 thereby to realize driving without slippage. As the timing belt 30 is placed in parallel and over the first and second pulleys 24, 28 of the same diameter, when the first pulley 24 rotates a predetermined angle in the clockwise direction relative to the connecting member 6, the second pulley 28 rotates the same angle as that of the first pulley 24, in the clockwise direction relative to the connecting member 6.

Figure 7:
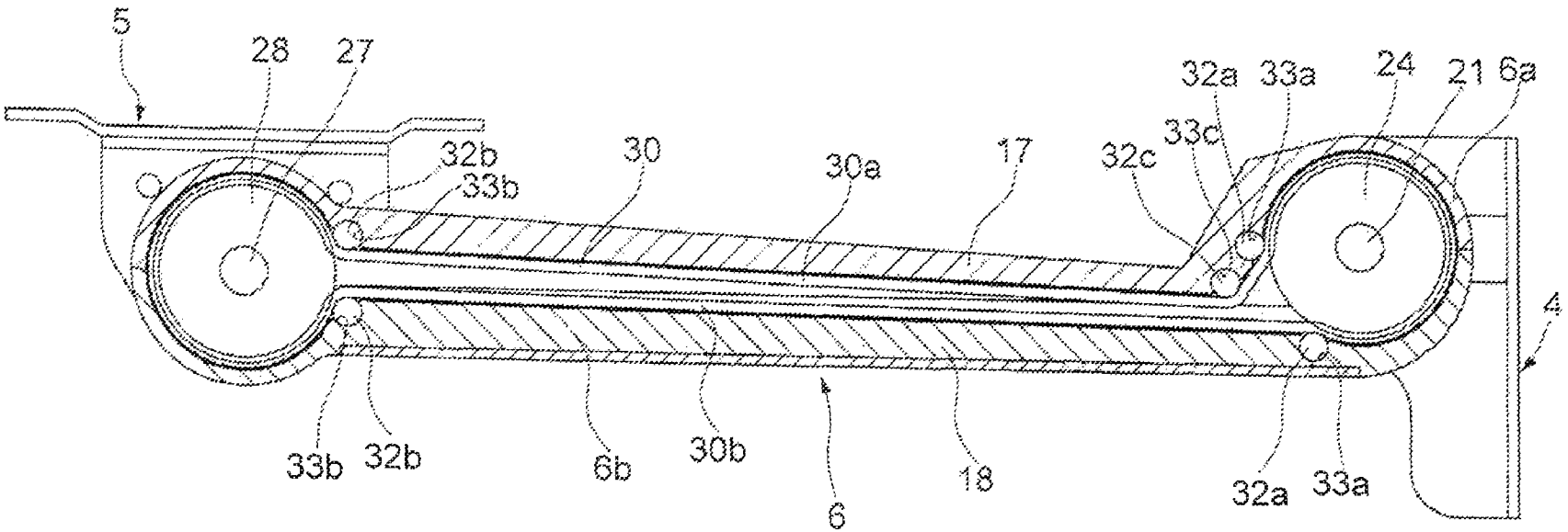
FIG. 7 is a cross sectional view taken along the line VII-VII of FIG. 5.

As illustrated in FIG. 7, the width between one side 30*a* and the opposite side 30*b* of the timing belt is narrowed by pins 32*a* to 32*c* that are abutting members abutting to the outside of the timing belt 30 and gets smaller than the diameters of the first pulley 24 and the second pulley 28. Out of the pins 32*a* to 32*c*, the pins 32*a* and 32*b* are totally four pins for narrowing the belt width, of which two are provided in the vicinity of the first pulley 24 and the other two are provided in the vicinity of the second pulley 28. The pin 32*c* is a pin for bending the belt, which is provided between the pins 32*a* for narrowing the belt width and the pins 32*b* for narrowing the belt width, in the vicinity of the first pulley 24.

The paired pins 32 for narrowing the belt width as first pulley abutting parts provided in the vicinity of the first pulley 24 abut to outside of the one side 30*a* and the opposite side 30*b* of the timing belt 30 to narrow the width between the one side 30*a* and the opposite side 30*b* of the timing belt 30. Then, the looping angle of the timing belt 30 on the first pulley 24 is made greater than 180 degrees. The pins 32*a* for narrowing the belt width are placed in touch with the first pulley 24 on which the timing belt 30 runs so that the timing belt 30 can be sandwiched between the first pulley 24 and the pins 32*a* for narrowing the belt width.

The paired pins 32*b* for narrowing the belt width as second pulley abutting parts provided in the vicinity of the second pulley 28 abut to outside of the one side 30*a* and the opposite side 30*b* of the timing belt 30 to narrow the width between the one side 30*a* and the opposite side 30*b* of the timing belt 30. Then, the looping angle of the timing belt 30 on the second pulley 28 is made greater than 180 degrees. The pins 32*b* for narrowing the belt width are placed in touch with the second pulley 28 on which the timing belt 30 runs so that the timing belt 30 can be sandwiched between the second pulley 28 and the pins 32*b* for narrowing the belt width. As the looping angle of the timing belt 30 is made larger than 180 degrees, engagement between the timing belt 30 and the first and second pulleys 24, 28 can be made stable.

The pins 32*c* for bending the belt is placed between the two-type pins 32*a* and 32*b* for narrowing the belt width abutting one side 30*a* of the timing belt 30 and in the vicinity of the first pulley 24. The pin 32*c* for bending the belt abuts to the outside of the one side of the timing belt 30 and bends the one side of the timing belt 30 by a predetermined angle. This pin 32*c* for bending the belt is provided to narrow the width of the timing belt 30 at the first pulley 24 side narrower than the timing belt 30 at the second pulley 28. These belt width narrowing pins 32*a*, 32*b* and belt bending pin 32*c* are fit in the connecting member 6. The belt bending pin 32*c* and the belt width narrowing pins 32*a*, 32*b* that abut to the one side 30*b* of the timing belt 30 are fit in the back-side split connecting member 17 and the belt width narrowing pins 32*a*, 32*b* that abut to the opposite side 30*b* of the timing belt 30 are fit in the front-side split connecting member 18. In the split connecting members 17, 18, pin fitting grooves 33*a* to 33*c* are formed corresponding to the pins 32*a* to 33*c*. The pins 32*a* to 32*c* are fit in the pin fitting grooves 33*a* to 33*c* in such a manner that the pins 32*a* to 32*c* are rotatable around the center line. The width between upper ends of each of the pin fitting grooves 33*a* to 33*c* is smaller than the diameter of the pin 32*a* to 32*c* in order to prevent the pins 32*a* to 32*c* from getting out of the pin fitting grooves 33*a* to 33*c* once they fit in the pin fitting grooves 33*a* to 33*c*. When the timing belt 30 runs, the pins 32*a* to 32*c* that abut to the timing belt 30 rotate around their center lines. This makes it possible to prevent occurrence of a frictional force on the timing belt 30 and to make the timing belt run smoothly.

The connecting member 6 surrounds the first and second pulleys 24 and 28 and the timing belt 30. The outer shape of each end 6*a* of the connecting member 6 is circular of which the diameter is slightly larger than the diameter of the first and second pulleys 24, 28. The width of the center part 6*b* of the connecting member 6 is set narrower than the width of the outer shape of each end 6*a*. Then, as the width of the timing belt 30 becomes gradually narrower from the second pulley 28 to the first pulley 24, the width of the center part 6*b* of the connecting member 6 becomes gradually narrower from the second pulley 28 to the first pulley 24. The width of the center part 6*b* of the connecting member 6 is set to be the smallest in the vicinity of the belt bending pin 32*c*.

Figure 8:
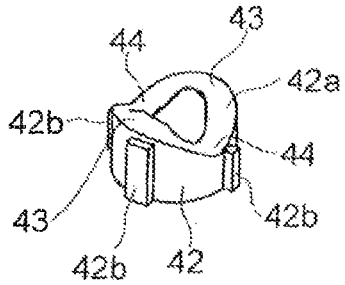
FIG. 8 is a perspective view of a cylindrical cam.
Figure 9:
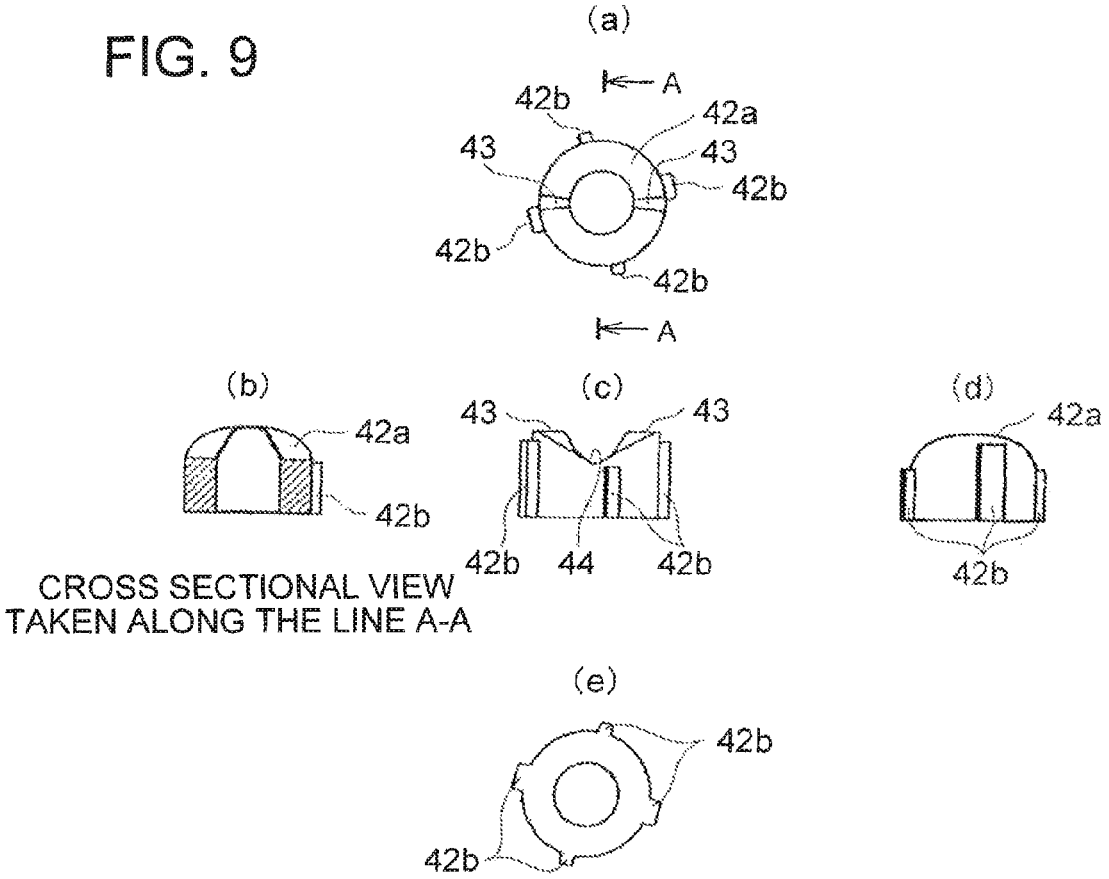
FIGS. 9(*a*) to 9(*e*) are detailed views of the cylindrical cam (FIG. 9(*a*) is a plan view, FIG. 9(*b*) is a cross sectional view, FIG. 9(*c*) is a side view, FIG. 9(*d*) is a side view, and FIG. 9(*e*) is a bottom view)

As illustrated in FIG. 6, a pair of protruding pins 41 protruding in the radial direction of the axis part 21 is integrally connected to the axis part 21 connected to the first mounting member 4. The paired protruding pins 41 are arranged around the axis part as 180-degree spaced from each other. FIGS. 8 and 9 are detailed views of the cylindrical cam 42 as a cam body that is inserted into the axis part 21. In an end surface of the cylindrical cam 42, a cam surface 42*a* is formed that abuts to the protruding pin 41. On this cam surface 42*a*, a protrusion and a depression are formed repeatedly in its circumferential direction. As illustrated in FIG. 9(*a*), apexes of a pair of protrusions 43 are formed 180-degree spaced from each other in the circumferential direction. A pair of depressions 44 is also formed 180-degree spaced from each other in the circumferential direction. In the outer periphery of the cylindrical cam 42, stoppers 42*b* extending in the direction of the axis line of the cylindrical cam 42 are formed 90-degree spaced from each other in the circumferential direction. These stoppers 42*b* are fit in the stopper guide grooves 45 (see FIGS. 10 and 12) of the connecting member 6 for allowing sliding of the cylindrical cam 42 relative to the connecting member 6 in the axis line direction of the axis part 21 and preventing rotation of the cylindrical cam 42 around the center line.

Around the axis part 21, a coil spring 46 is wound as biasing means for biasing the cylindrical cam 42 toward the protruding pins 41. The coil spring 46 is arranged between the cylindrical cam 42 and the flange 21*a* of the axis part 21. When the connecting member 6 rotates relative to the first mounting member 4, the cylindrical cam 42 rotates relative to the protruding pin 41 and the cylindrical cam 42 goes up or down. When the door 2 is closed, the door 2 is given a torque in the closing direction by the biasing force of the coil spring 46 (see FIG. 2). When the door 2 gets open and the open angle of the door 2 exceeds 80 degrees, the protruding pin 41 goes over the top of the cam surface 42*a* of the cylindrical cam 42. Then, the door 2 is given a torque that supports rotation in the open direction by the biasing force of the coil spring 46. When the door 2 is fully opened, the door 2 is given a torque in the open direction by the biasing force of the coil spring 46 so as to keep the fully opened state. In closing the fully-opened door 2, when the open angle of the door 2 becomes 80 degrees, for example, the direction of the torque to apply is switched.

As illustrated in FIG. 6, the axis part 27 of the second mounting member 5 is connected integrally with a gear 51. A part of the periphery of the gear 51 is lost. In the connecting member 6, a rotary damper 52 that engages with the gear 51 is fit therein. A gear part 52*a* of the rotary damper 52 rotates relative to a main part 52*b*, there occurs a damping force against the rotation. In the main part 52*b* of the rotary damper 52, a viscous fluid is filled therein for absorbing energy of the rotation as thermal energy with use of the viscous resistance. When the gear 51 engages with the gear part 52*a* of the rotary damper 52, there occurs a damping force that resists rotation of the gear 51. Meanwhile, when the gear 51 does not engage with the gear part 52*b* of the rotary damper 52, there occurs no damping force. Just before the door 2 opens or closes completely, the gear 51 engages with the gear part 52*a* of the rotary damper 52 and there occurs a damping force against rotation of the door 2. This attenuates impact when the door 2 opens or closes completely. In this embodiment, the door 2 can rotate 150 degrees. The rotary damper 52 always generates a damping force 52 both in the normal rotation and reverse rotation. The gear 51 engages with the gear part 52*b* of the rotary damper 52 at the angles of 0 (closed state) to 30 degrees and at the angles of 120 to 150 degrees (fully opened range) where there occurs a damping force. The gears do not engage at the angles of 30 to 120 degrees and there occurs no damping force.

Figure 10:
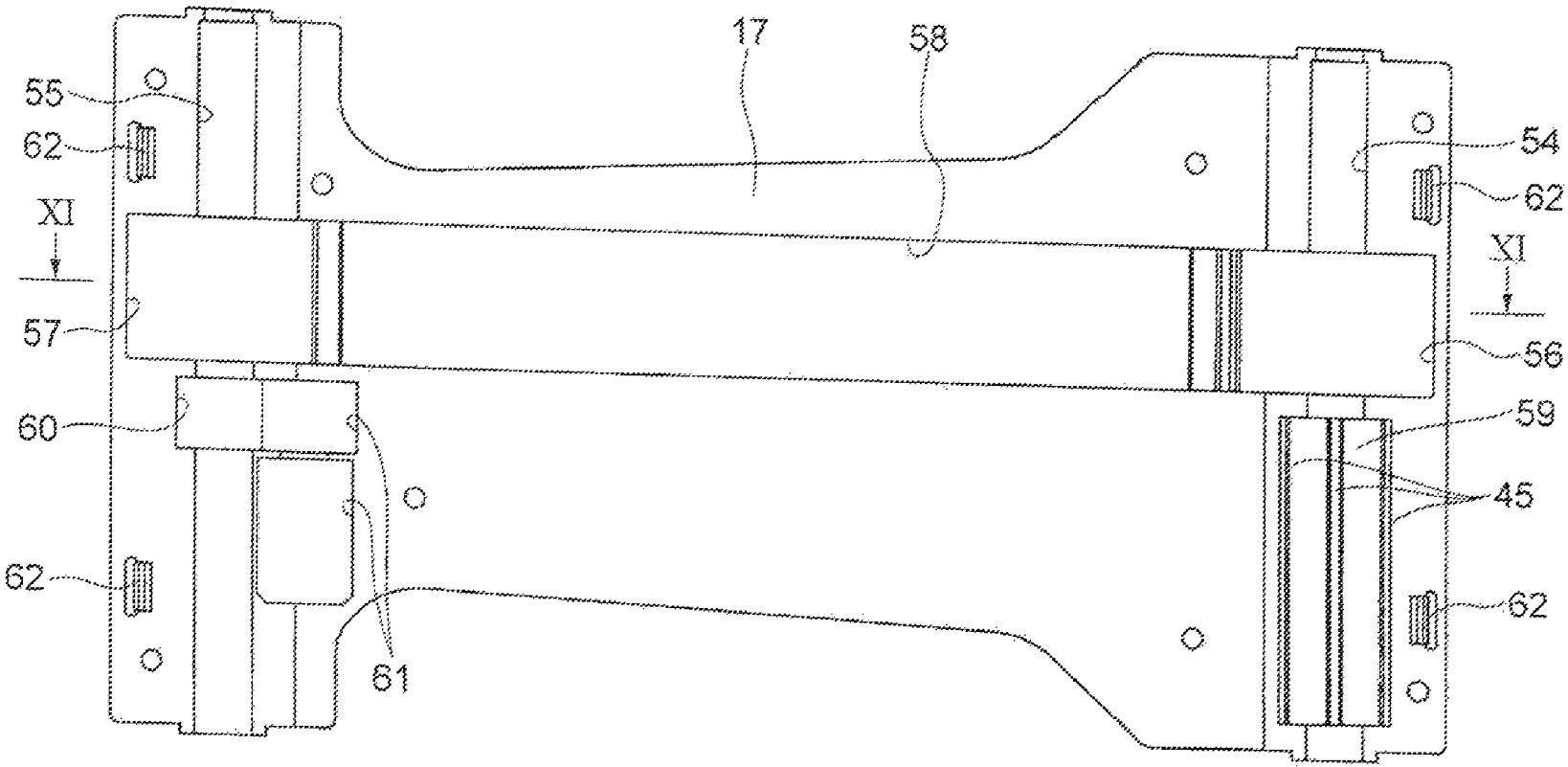
FIG. 10 is a front view of a back-side split connecting member.
Figure 11:
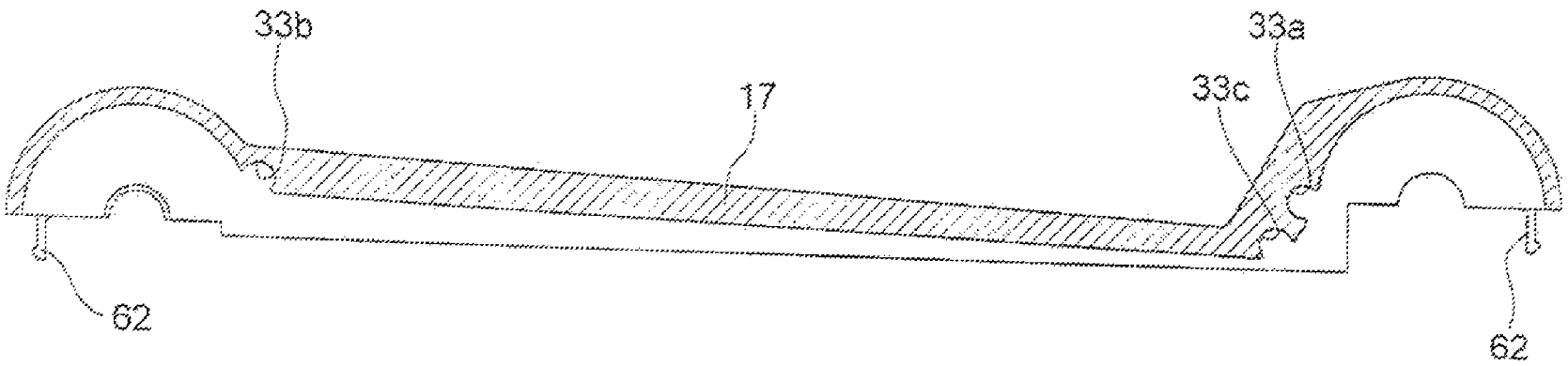
FIG. 11 is a cross sectional view taken along the line XI-XI of FIG. 10.

FIGS. 10 and 11 are detailed views of the back-side split connecting member 17. FIG. 10 is a front view of the split connecting member 17 and FIG. 11 is a cross sectional view of the split connecting member 17. In the split connecting member, first and second axis part fitting grooves 54 and 55 are formed in which the axis parts 21 and 27 of the first mounting member 4 and the second mounting member 5 are fit so as to be rotatable. Besides, in order to avoid interference with the first pulley 24 and the second pulley 28, a first pulley groove 56 and a second pulley groove 57 are formed for fitting the first pulley 24 and the second pulley 28 therein, respectively. Further, between the first and second pulley grooves 56, 57, a timing belt groove 58 is formed as a looping member groove for fitting the timing belt 30 therein. As illustrated in FIG. 11, in the timing belt groove 58, pin fitting grooves 33*a* to 33*c* are formed for inserting the pins 32*a* to 32*c* thereinto so that the pins 32*a* to 32*c* are rotatable around the axis lines.

As illustrated in FIG. 10, in the first axis part fitting groove 54, a cam guide groove 59 is formed for inserting the cylindrical cam 42 slidably. In the cam guide groove 59, stopper guide grooves 45 are formed for fitting the stoppers 42*b* of the cylindrical cam 42 therein. Out of these stopper guide grooves 45, one is formed at the bottom of the cam guide groove 59 and two are formed at the joint surface of the split connecting member 17. When the front-side split connecting member 18 is connected to the back-side split connecting member 17, totally four stopper guide grooves 45 are formed.

In the second axis part fitting groove 55, a gear groove 60 is formed for fitting the gear 51 therein and a rotary damper groove 61 is also formed for fitting the rotary damper 52 therein. When the back-side split connecting member 17 is connected to the front-side split connecting member 18, the main body 52*b* of the rotary damper 52 is fixed so as not to rotate relative to the connecting member 6. On the other hand, as the gear part 52*a* of the rotary damper 52 and the gear 51 are spaced from the connecting member 6, they are rotatable relative to the connecting member 6. As illustrated in FIG. 11, a hook 62 is formed in the back-side split connecting member 17 for connecting to the front-side split connecting member 18.

Figure 12:
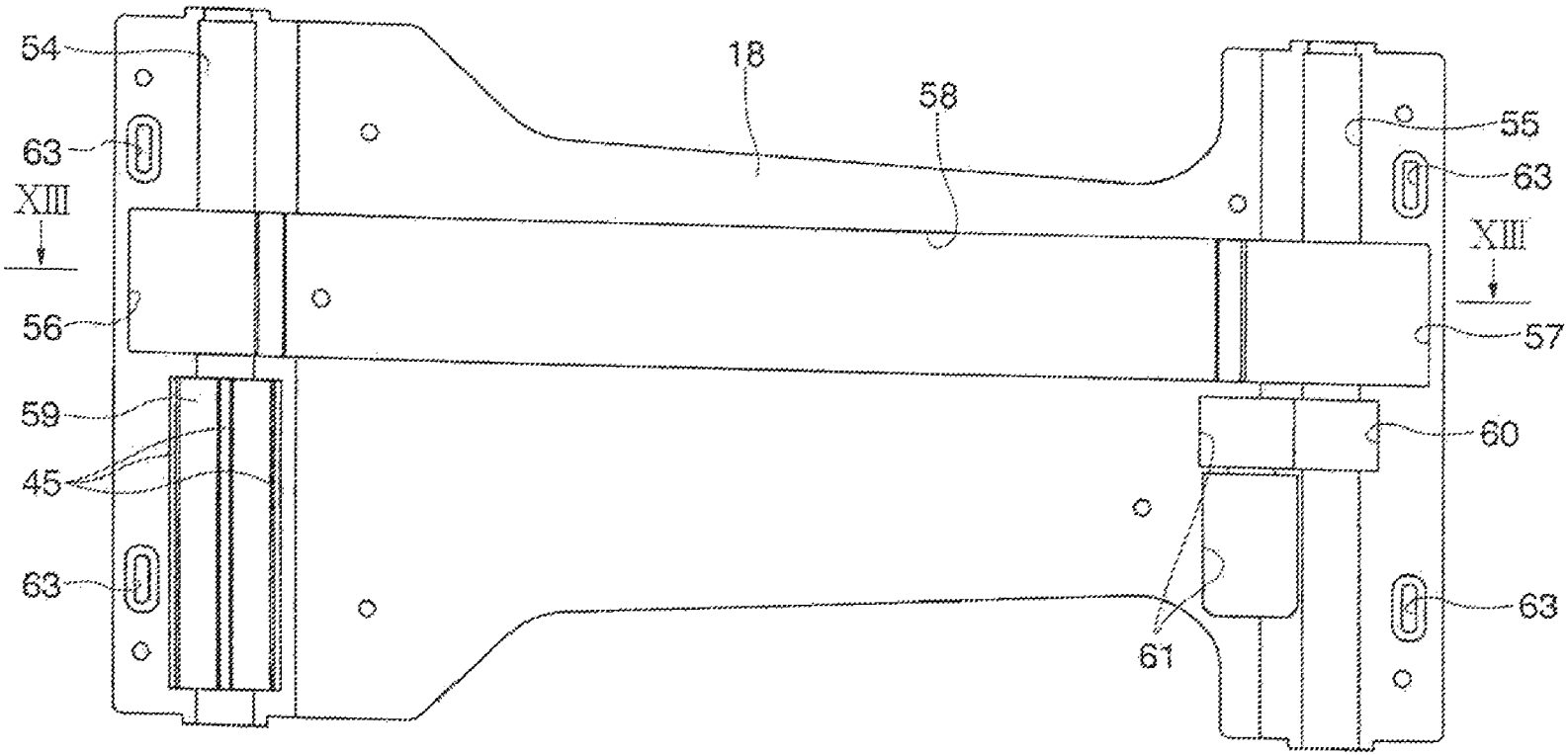
FIG. 12 is a front view of a front-side split connecting member.
Figure 13:
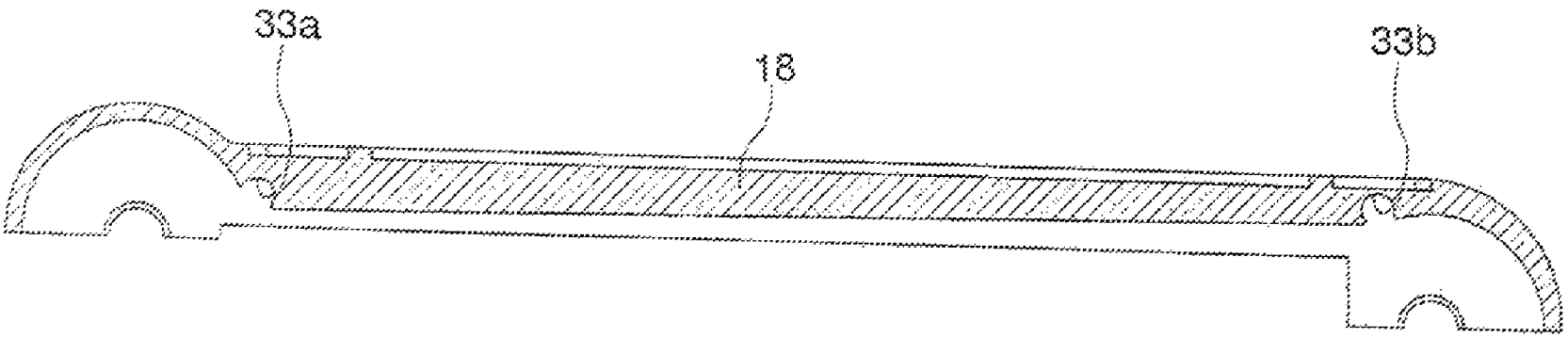
FIG. 13 is a cross sectional view taken along the line XIII-XIII of FIG. 12.

FIGS. 12 and 13 illustrate the front-side split connecting member 18 in detail. FIG. 12 is a front view of the split connecting member and FIG. 13 is a cross sectional view thereof. Also in the front-side split connecting member 18, first and second axis part fitting grooves 54, 55 are formed corresponding to the axis parts 21, 27 of the first and second mounting members 4, 5, respectively so as to make the axis parts 21, 27 of the first and second mounting members 4, 5 rotatable. Besides, in order to avoid interference with the first pulley 24 and the second pulley 28, first and second pulley grooves 56, 57 are formed for fitting the first and second pulleys 24, 28, respectively. Between the first and second pulley grooves 56, 57, a timing belt groove 58 is formed for fitting the timing belt 30 therein. As illustrated in FIG. 13, in the timing belt groove 58, pin fitting grooves 33*a* and 33*b* are formed for inserting the pins 32*a* and 32*b* therein to be rotatable around there axis lines.

As illustrated in FIG. 12, in the first axis part fitting groove 54, a cam guide groove 59 is formed for fitting the cylindrical cam 42 slidably. In the cam guide groove 59, stopper guide grooves 45 are formed for fitting the stoppers 42*b* of the cylindrical cam 42. Out of the stopper guide grooves 45, one is formed at the bottom of the cam guide groove 59 and two are formed on the joint surface of the split connecting member 18. In the second axis part fitting groove 55, a gear groove 60 is formed for fitting the gear 51 therein and a rotary damper groove 61 is formed for fitting the rotary damper 52 therein. In the front-side split connecting member 18, a hole 63 is formed for inserting the hook 62 of the back-side split connecting member 17.

The above-described hinge device is assembled in the following manner. First, the axis part 21 to which the first pulley 24 is connected is mounted on the first mounting member 4 and the axis part 27 to which the second pulley 28 is connected is mounted on the second mounting member 5. The timing belt 30 is made to run between the first pulley 24 and the second pulley 28. After the cylindrical cam 42 and the coil spring 46 are inserted into the axis part of the first mounting member 4, as illustrated in FIG. 6, the axis parts 21 and 27 of the first and second mounting members 4 and 5 are fit in the first and second axis part fitting grooves 54 and 55 of the back-side split connecting member 17. Through these steps, the axis parts 21 and 27 of the first and second mounting members 4 and 5 are positioned relative to the split connecting member 17 and their spacing is maintained appropriately. The pins 32*a* to 32*c* are already fit in the pin fitting grooves 33*a* to 33*c* of the back-side split connecting member 17. The timing belt 30 is not given tension only by fitting the axis parts 21 and 27 of the first and second mounting members 4 and 5 in the back-side split connecting member 17. Then, the axis parts 21 and 27 of the first and second mounting members 4 and 5 remain rotatable relative to the back-side split connecting member 17.

In assembling the hinge device, the angle of the door mounting plate 5*a* of the second mounting member 5 relative to the main plate 4*a* of the first mounting member 4 is set to be a predetermined angle, or in other words, the first mounting member 4 and the second mounting member 5 need to be in phase. As illustrated in FIG. 2, when closing the door 2 (S1), the door 2 abuts to the left side and right side of the flame la simultaneously. If the attitude of the door 2 is shifted even slightly, the door 2 is to abut to either of the left side and the right side of the frame 1*a*. In order that the door abuts to the left and right sides of the frame 1*a* simultaneously, the first mounting member 4 and the second mounting member 5 need to be in phase precisely. As illustrated in FIG. 6, when the first and second mounting members 4 and 5 are set in the back-side split connecting member 17, the timing belt 30 is not given tension as described above and the axis parts 21 and 27 of the first and second mounting members 4 and 5 are rotatable relative to the back-side split connecting member 17 freely. While the axis parts 21 and 27 remain rotatable freely, a jig is used to make the first mounting member 4 and the second mounting member 5 in phase with each other.

To the back-side split connecting member 17, the front-side split connecting member 18 is connected in such a manner as to put a cap thereon. When the hook 62 of the back-side split connecting member 17 is fit in the hole 63 of the front-side split connecting member 18, the split connecting members 17 and 18 become inseparatable from each other. Once the front-side split connecting member 18 is connected to the back-side split connecting member 17, the pins 32*a* and 32*b* of the front-side split connecting member 18 abut to the timing belt 30 and the timing belt 30 is given tension. When the tension is applied to the timing belt 30, the timing belt 30 is completely engaged with the first and second pulleys 24 and 28 and the first pulley 24 and the second pulley 28 are prevented from being out of phase from each other. Finally, the front-side split connecting member 18 and the back-side split connecting member 17 are firmly connected with each other by screws.

Figure 14:
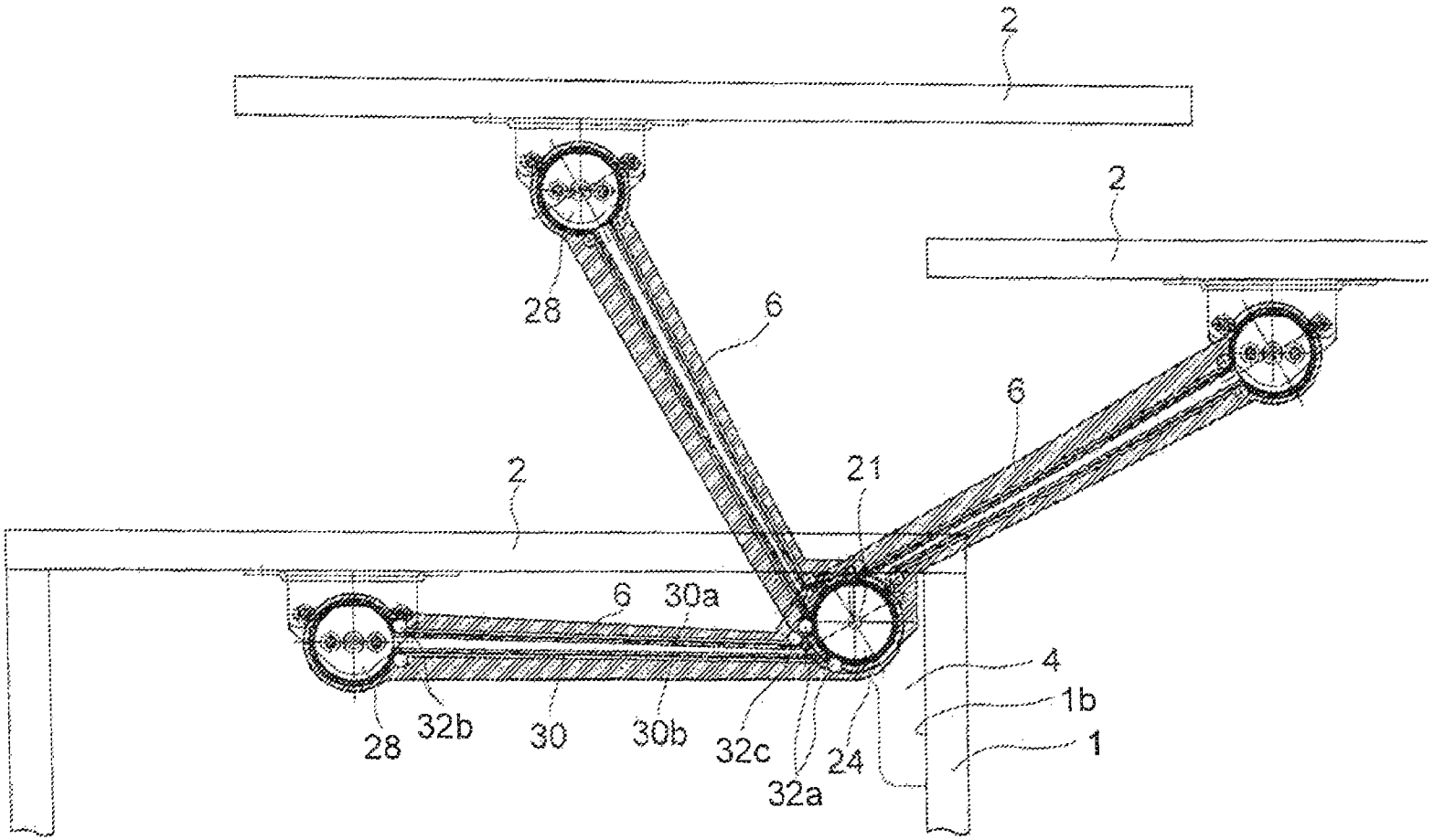
FIG. 14 is a view illustrating the operation of the hinge device when opening or closing the door.
Figure 15:
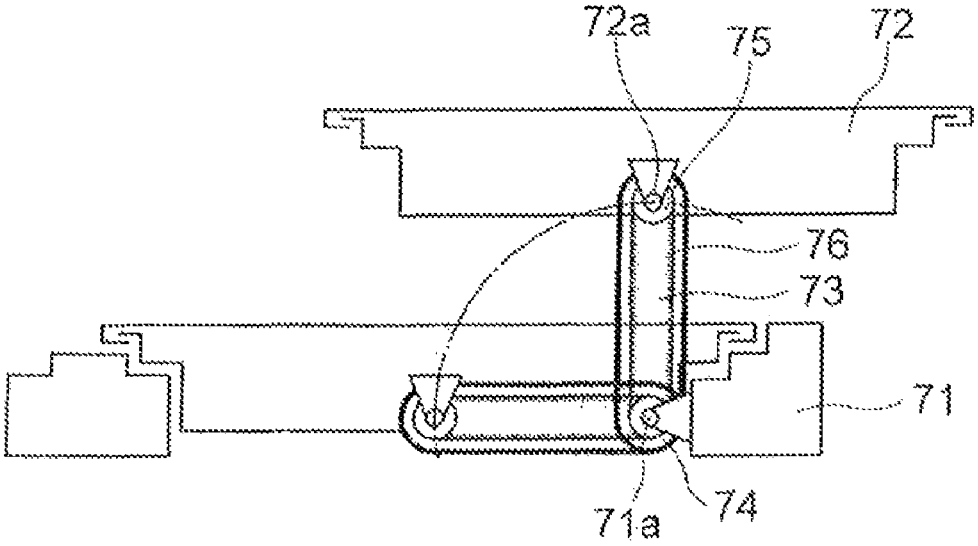
FIG. 15 is a plan view of a conventional hinge device.
Figure 16:
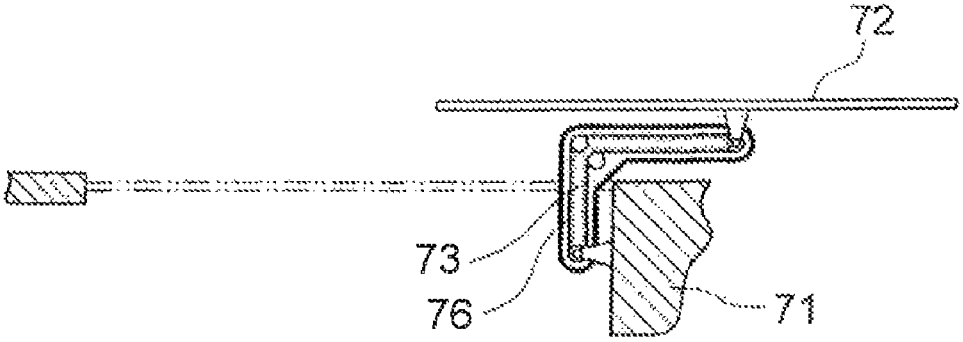
FIG. 16 is a plan view of a hinge device in which a link and a timing belt are bent into L shape.

FIG. 14 is a view illustrating the operation of the hinge device when opening or closing the door 2. When the door knob is grasped to open or close the door 2, the connecting member 6 rotates around the axis part 21 of the first mounting member 4 mounted on the housing 1 so that the door 2 pivots around the axis part 21 of the first mounting member 4. When the connecting member 6 rotates a predetermined angle in the clockwise direction around the axis part 21 of the first mounting member 4, the first pulley 24 fixed to the first mounting member 4 rotates a predetermined angle in the counterclockwise direction relative to the connecting member 6. Counterclockwise rotation of the first pulley 24 relative to the connecting member 6 is transmitted to the second pulley 28 via the timing belt 30 and the second pulley 28 rotates a predetermined angle in the counterclockwise direction relative to the connecting member 6. The attitude of the door 2 relative to the housing 1 is defined by combination of the rotation angle of the connecting member 6 relative to the first mounting member 4 and the rotation angle of the second pulley 28 relative to the connecting member 6. As the rotation angle of the connecting member 6 and the rotation angle of the second pulley relative to the connecting member 6 cancel out each other, the attitude of the door 2 is maintained fixed while the door 2 gets opened or closed.

The width between the one side 30*a* and the opposite side 30*b* of the timing belt 30 is narrowed by the four pins 32*a* and 32*b*. Besides, in the split connecting members 17, 18, timing belt grooves 58 are formed for fitting the timing belt 30 therein. This makes it possible to reduce the width of the connecting member 6 that surrounds the timing belt 30. Therefore, even when the open angle of the door 2 relative to the housing 1 is made larger, it becomes possible to prevent interference between the inner surface lb of the housing 1 and the connecting member 6. Further, as the width of the connecting member 6 at the side of the first pulley 24 is smaller than the width of the connecting member at the side of the second pulley 28 and the width of the connecting member 6 is made the smallest in the vicinity of the belt bending pin 32*c*, the open angle of the door 2 relative to the housing 1 can be made greater.

Here, the present invention is not limited to the above-described embodiment and may be embodied in various forms without departing from the scope of the present invention. For example, the above-mentioned hinge device can be used to open and close the opening of an airplane or auto car as well as the furniture. Besides, when opening or closing the door, the door needs not be maintained in parallel with the frame of the housing as far as the attitude of the door can be maintained unchanged.

The front-side split connecting member may be further divided into two or more. Further, the cylindrical cam may be mounted on the axis part of the second mounting member and the rotary damper may be mounted on the axis part of the first mounting member. Both of the cylindrical cam and the rotary damper may be mounted on either of the axis part of the first mounting member and the axis part of the second mounting member. The abutting part may not be a pin but a protrusion formed integral with the connecting member. The looping member may be a chain or rope instead of the timing belt.

Furthermore, the diameter of the first pulley may be different from that of the second pulley. In such a case, the width between both sides of the timing belt is preferably smaller than the diameter of the smaller pulley, but may be smaller than the diameter of the larger pulley.

The present specification is based on Japanese Patent Applications No. 2008-235392 filed on Sep. 12, 2008, the entire contents of which are expressly incorporated by reference herein.

[Reference Numerals]

1 . . . housing (first member)
2 . . . door (second member)
4 . . . first mounting member
5 . . . second mounting member
6 . . . connecting member
17 . . . back-side split connecting member
18 . . . front-side split connecting member
21 . . . axis part of first mounting member
24 . . . first pulley
27 . . . axis part of second mounting member
28 . . . second pulley
30 . . . timing belt (looping member)
30*a* . . . one side
30*b* . . . the opposite side
32*a* . . . pin for narrowing belt width (first pulley side abutting part)
32*b* . . . pin for narrowing belt width (second pulley side abutting part)
32*c* . . . pin for bending belt (abutting part)
33*a* to 33*c* . . . pin fitting groove
41 . . . protruding pin
42 . . . cylindrical cam (cam body)
42*a* . . . cam surface
42*b* . . . stopper
51 . . . gear
52 . . . rotary damper
56, 57 . . . pulley groove
58 . . . timing belt groove
59 . . . cam guide groove
60 . . . gear groove
61 . . . rotary damper groove

The invention claimed is:

1. A hinge device for opening and closing a second member relative to a first member, comprising:

a first mounting member that is adapted to be mounted on the first member and that has an axis part;

a second mounting member that is adapted to be mounted on the second member and that has an axis part;

a first pulley that is fixed to said axis part of the first mounting member;

a second pulley that is fixed to said axis part of the second mounting member;

a looping member that runs between the first pulley and the second pulley;

a connecting member that is connected to said axis part of the first mounting member to be rotatable relative to said first mounting member and is connected to said axis part of the second mounting member to be rotatable relative to said second mounting member; and an abutting part that abuts to an outside of the looping member in such a manner that a width between one side of the looping member and an opposite side thereof becomes smaller than a diameter of at least one of the first pulley and the second pulley.

2. The hinge device of claim 1, wherein the abutting part has at least two first-pulley side abutting parts that are provided near the first pulley and abut to the one side and the opposite side of the looping member, respectively, in such a manner that a looping angle of the looping member on the first pulley is greater than 180degrees.

3. The hinge device of claim 2, wherein the connecting member has two or more split connecting members that are split at the first pulley and the second pulley, the abutting part is provided at at least one of the split connecting members, and a tension is applied to the looping member from the abutting part by connecting the split connecting members to each other.

4. The hinge device of claim 2, wherein each of the at least two first-pulley side abutting parts comprises a pin that is fit in the connecting member rotatably, and when the looping member runs, the pin abuts to the looping member and the pin rotates around a center line thereof.

5. The hinge device of claim 2, wherein a first gear is connected to one of said axis parts, a rotary damper comprising a second gear part that engages with the first gear is fit in the connecting member, and when the connecting member is rotated, the rotary damper generates a damping force that resists relative rotation of the connecting member.

6. The hinge device of claim 2, wherein a protruding pin is connected to one of the axis parts, there is a cam body that is slidable in an axis direction of the axis part that has the protruding pin, said cam body being fit in the connecting member, wherein said cam body is stopped to rotate by the connecting member, and there is a biasing member for biasing the cam body to the protruding pin, and when the connecting member is rotated, a torque is applied to the connecting member by a biasing force of the biasing member.

7. The hinge device of claim 2, wherein the abutting part has at least two second-pulley side abutting parts that are provided near the second pulley and abut to the one side and the opposite side of the looping member, respectively, in such a manner that a looping angle of the looping member on the second pulley is greater than 180degrees.

8. The hinge device of claim 7, wherein the connecting member has two or more split connecting members that are split at the first pulley and the second pulley, the abutting part is provided at at least one of the split connecting members, and a tension is applied to the looping member from the abutting part by connecting the split connecting members to each other.

9. The hinge device of claim 7, wherein each of the at least two second-pulley side abutting parts comprises a pin that is fit in the connecting member rotatably, and when the looping member runs, the pin abuts to the looping member and the pin rotates around a center line thereof.

10. The hinge device of claim 7, wherein a first gear is connected to one of said axis parts, a rotary damper comprising a second gear part that engages with the first gear is fit in the connecting member, and when the connecting member is rotated, the rotary damper generates a damping force that resists relative rotation of the connecting member.

11. The hinge device of claim 1, wherein the connecting member has two or more split connecting members that are split at the first pulley and the second pulley, the abutting part is provided at at least one of the split connecting members, and a tension is applied to the looping member from the abutting part by connecting the split connecting members to each other.

12. The hinge device of claim 11, wherein the abutting part comprises a pin that is fit in the connecting member rotatably, and when the looping member runs, the pin abuts to the looping member and the pin rotates around a center line thereof.

13. The hinge device of claim 11, wherein a first gear is connected to one of said axis parts, a rotary damper comprising a second gear part that engages with the first gear is fit in the connecting member, and when the connecting member is rotated, the rotary damper generates a damping force that resists relative rotation of the connecting member.

14. The hinge device of claim 11, wherein in at least one of the split connecting members, a first pulley groove and a second pulley groove are formed for fitting the first pulley and the second pulley therein, respectively, and a looping member groove is formed for fitting the looping member therein.

15. The hinge device of claim 14, wherein the abutting part comprises a pin that is fit in the connecting member rotatably, and when the looping member runs, the pin abuts to the looping member and the pin rotates around a center line thereof.

16. The hinge device of claim 14, wherein a first gear is connected to one of said axis parts, a rotary damper comprising a second gear part that engages with the first gear is fit in the connecting member, and when the connecting member is rotated, the rotary damper generates a damping force that resists relative rotation of the connecting member.

17. The hinge device of claim 1, wherein the abutting part comprises a pin that is fit in the connecting member rotatably, and when the looping member runs, the pin abuts to the looping member and the pin rotates around a center line thereof.

18. The hinge device of claim 17, wherein a first gear is connected to one of said axis parts, a rotary damper comprising a second gear part that engages with the first gear is fit in the connecting member, and when the connecting member is rotated, the rotary damper generates a damping force that resists relative rotation of the connecting member.

19. The hinge device of claim 1, wherein a first gear is connected to one of said axis parts, a rotary damper comprising a second gear part that engages with the first gear is fit in the connecting member, and when the connecting member is rotated, the rotary damper generates a damping force that resists relative rotation of the connecting member.

20. The hinge device of claim 1, wherein a protruding pin is connected to one of the axis parts, a cam body is fit in the connecting member, said cam body being slidable in an axis direction of the axis part that has the protruding pin, wherein said cam body is stopped to rotate by the connecting member, and there is a biasing member for biasing the cam body to the protruding pin, and when the connecting member is rotated, a torque is applied to the connecting member by a biasing force of the biasing member.

* * * * *

UNITED STATES PATENT AND TRADEMARK OFFICE

CERTIFICATE OF CORRECTION

PATENT NO. : 8,365,359 B2
APPLICATION NO. : 13/063851
DATED : February 5, 2013
INVENTOR(S) : Morishita et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 4 days.

Signed and Sealed this
First Day of September, 2015

Michelle K. Lee

Michelle K. Lee
*Director of the United States Patent and Trademark Office*